United States Patent [19]

Sun

[11] Patent Number: 4,561,156

[45] Date of Patent: Dec. 31, 1985

[54] ROLLER FOR SUGAR CANE SQUEEZING MILLS

[76] Inventor: Ting-Zui Sun, No. 111, Fu-Nei La., Kao-Tan Village, Jen-Wu Country, Kao-Shiung Hsien, Taiwan

[21] Appl. No.: 745,826

[22] Filed: Jun. 18, 1985

Related U.S. Application Data

[63] Continuation of Ser. No. 502,751, Jun. 9, 1983.

[51] Int. Cl.[4] ..... B21B 27/02

[52] U.S. Cl. ..... 29/121.6; 100/121; 100/176; 241/294

[58] Field of Search ..... 241/227–234, 241/294; 29/121.1, 121.6, 121.7, 124, 129; 100/121, 155 R, 176

[56] References Cited

U.S. PATENT DOCUMENTS

| | | | |
|---|---|---|---|
| 901,873 | 10/1908 | Brubaker | 29/124 |
| 1,209,736 | 12/1916 | Lauterbach | 29/124 |
| 3,969,802 | 7/1976 | Bouvet | 29/121.6 |
| 4,116,594 | 9/1978 | Leanna et al. | 29/124 X |
| 4,167,387 | 9/1979 | Buchholz | 29/124 X |
| 4,391,026 | 7/1983 | Casey et al. | 29/121.6 |

*Primary Examiner*—Mark Rosenbaum
*Assistant Examiner*—Timothy V. Eley
*Attorney, Agent, or Firm*—Armstrong, Nikaido, Marmelstein & Kubovcik

[57] ABSTRACT

An improved roller for sugar cane squeezing mills, comprising a roller shaft, a mounting sleeve tightly fit over the roller shaft, a plurality of roller shell segments detachably mounted onto the peripheral surface of the mounting sleeve. The mounting sleeve is provided with a plurality of longitudinal slots equally spaced around the peripheral surface thereof. Each roller shell segment has a plurality of peripheral grooves and ridges on the outer side and a longitudinal key on the inner side to fit one of the longitudinal slots of the mounting sleeve. In a preferred embodiment a space is provided between each longitudinal slot of the mounting sleeve and each longitudinal key of the roller shell segment so as to form a passage, and juice collecting ports are provided in each groove of the roller shell segments to communicate with the aforesaid passage.

1 Claim, 17 Drawing Figures

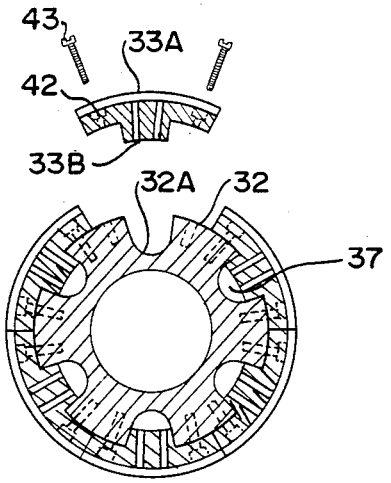
FIG. 14
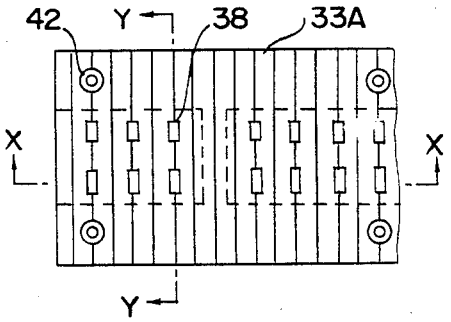
FIG. 15
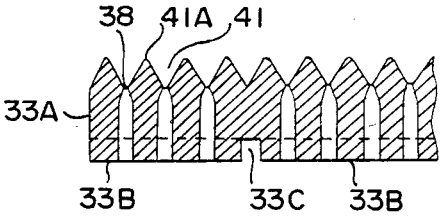
FIG. 16 SECTION X-X
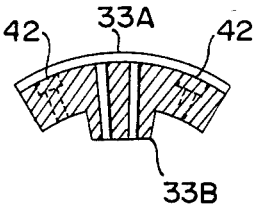
FIG. 17 SECTION Y-Y

ROLLER FOR SUGAR CANE SQUEEZING MILLS

This application is a continuation of application Ser. No. 502,751 filed June 9, 1983.

DESCRIPTION OF THE PRIOR ART

A conventional sugar cane squeezing mill generally comprises three rollers as shown in FIG. 1; namely a top roller 1, a feeding roller 2, and a discharging roller 3, wherein feeding roller 2 and discharging roller 3 are also called bottom rollers. The mill is driven by a driving device, not shown, to cause each roller to rotate in a direction as shown by the arrows in the drawing. Sugar cane S is fed into the mill from one side to be first squeezed by top roller 1 and feeding roller 2, and then by top roller 1 and discharging roller 3, to release the juice into a receiver C. The remainder of the sugar cane after being squeezed, or the bagasse B, is discharged from the opposite side of the mill as shown in FIG. 1.

In this arrangement the rollers 1, 2 and 3 are generally identical and are each, as shown in FIG. 2, provided with a roller shaft 4, a cylindrical roller shell 5 tightly fit over roller shaft 4, and two flanges 6 fixedly provided onto the two opposite ends of roller shell 5. In order to facilitate the squeezing of sugar cane, roller shell 5 is provided with a plurality of annular grooves 7 and ridges 7A on its cylindrical surface.

In operation, however, part of the cane juice released from the sugar cane squeezed by top roller 1 and feeding roller 2 tends to be forced to flow against the feeding of the sugar cane and to remain in entry zone A on the feeding side of the mill, as shown in FIG. 1. Such sugar cane juice remaining in the entry zone A tends to cause slippage of the mill, thus resulting in a reduction of the squeezing capacity. Furthermore, part of the cane juice already released from the sugar cane also tends to remain in the discharge zone D, and is re-absorbed by the bagasse and wastefully discarded.

In order to effectively collect the cane juice remaining in the entry zone A and in the discharge Zone D, (FIG. 1) and also to prevent the slippage of the mill, an improved top roller 10, as shown in FIGS. 3 and 4, known as a Lotus Roller or Perforated Roller, has been offered. Such a roller, as shown in FIG. 4, comprises a roller shaft 11, a cylindrical roller shell 12 tightly fit over roller shaft 11, and two flanges 17 fixedly provided on the two opposite ends of roller shell 12; roller shell 12 having a plurality of annular grooves 14 and ridges 14A on its cylindrical surface, a plurality of longitudinal holes or juice gutters 13; and apertures 16, generally called juice collecting nozzles, in annular grooves 14 to communicate with longitudinal holes 13. Each flanges 17 is provided with openings 18 to clear the end opening of each longitudinal hole 13. The juice collecting nozzle 16, as shown in FIG. 5, is formed by a plug member 15 having an elongated opening as shown in FIGS. 6 and 7, the plug member 15 being fit into a hole formed in annular groove 14 of roller shell 12 and welded onto roller shell 12. In operation, the cane juice remaining in the entry zone A and in the discharge zone D flows through juice collecting nozzles 16, longitudinal holes 13 and openings 18 of flanges 17 and drops into receiver C as shown in FIG. 3.

The Perforated Roller 10 as described above is capable of effectively collecting the cane juice remaining in the entry zone in the entry zone and in the discharge zone on the opposite sides of the mill and thus prevent the mill from sliping; however, the discharge nozzles 16 and longitudinal holes 13 tend to be quickly clogged with fine bagasse and frequent cleaning is therefore necessary. This is because the surface of the welded area of plug members 15 is generally left unfinished and the interior of longitudinal holes 13 remains rough after roller shell 12 has been made by casting process. Furthermore, there is a common disadvantage with the above-mentioned conventional rollers. The ridges 14A formed between each two grooves 14 tend to wear quickly and the roller shells must be repaired or replaced of a certain time interval. Since the roller shell is generally made of a cylindrical shaped single piece and is shrunk-fit over the roller shaft whose two ends are rotatably supported by the bearing device of the mill, not shown, the roller must be first dismounted from the mill in order to remove the roller shell from the roller when the roller shell has to repaired or replaced even for such minor damage as a crack or a clip-off. Such a repair process incurs a long machine downtime and high repair costs.

BRIEF DESCRIPTION OF THE INVENTION

In view of the aforesaid problems with conventional rollers for sugar cane squeezing mills, this invention presents an improved construction of the roller wherein the roller shell is split into a plurality of longitudinal shell segments which are detachably mounted onto the peripheral surface of a mounting sleeve fixedly mounted over the roller shaft. The mounting sleeve is provided with a plurality of longitudinal slots which are equally spaced around the periphery of the mounting sleeve. Each shell segment has an outer surface formed with a plurality of arcuate grooves and ridges in the peripheral direction and an inner surface provided with a longitudinal key to fit one longitudinal slot of the mounting sleeve. The longitudinal slots of the mounting sleeve may be deepened to provide a space between the longitudinal slot of the mounting sleeve and the longitudinal key of the shell segment so as to form a passage, and the shell segment may be provided with apertures, or juice collecting ports to communicate with the deepened slots, i.e., the passages on the mounting sleeve.

Therefore, it is a main object of this invention to provide an improved construction of the roller for sugar cane squeezing mills, having a roller shell split into several segments that can be replaced individually without the need of dismantling the roller from the mill.

It is another object of this invention to provide an improved construction of the roller for sugar cane squeezing mills, having a roller shell split into several segments and provided with juice collecting ports through which the cane juice squeezed by the mill may be collected.

BRIEF DESCRIPTIQN OF THE DRAWINGS

FIG. 14 is a transversal, cross sectional view of the second embodiment of the improved roller as shown in FIG. 11, with one shell segment removed from the mounting sleeve.

FIG. 15 is an enlarged, fragmentary top view of a shell segment employed in the second embodiment as shown in FIG. 11.

FIG. 16 is an enlarged, fragmentary, longitudinal sectional view of the shell segment, taken along the section line X—X of FIG. 15.

FIG. 17 is an enlarged, fragmentary, transversal sectional view of the shell segment, taken along the section line Y—Y of FIG. 15.

DETAILED DESCRIPTION OF THE INVENTION

Figure 8:
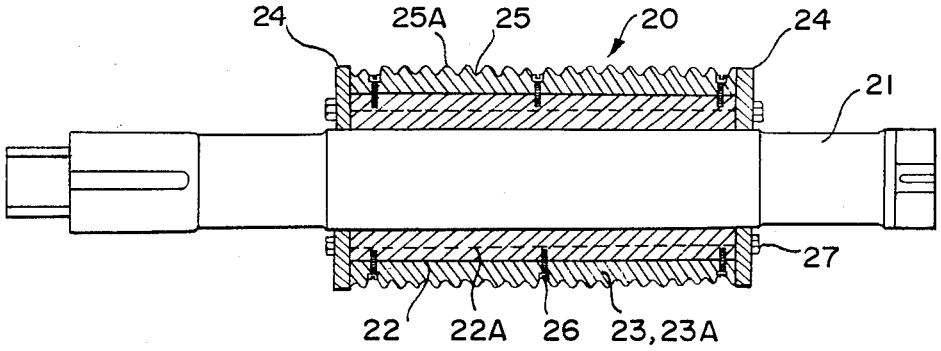
FIG. 8 is a longitudinal, sectional view of a first embodiment of the improved roller according to this invention.
Figure 10:
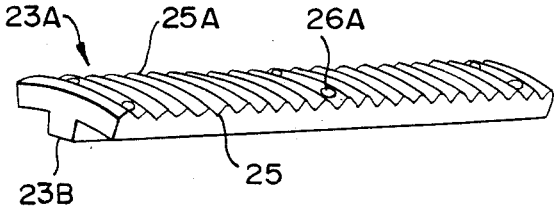
FIG. 10 is an oblique, perspective view of one of the shell segments employed in the first embodiment of the improved roller as shown in FIG. 8.
Figure 9:
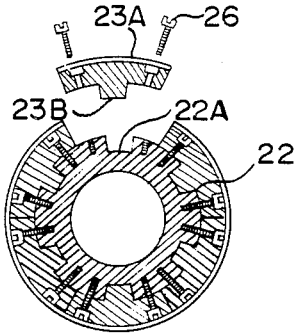
FIG. 9 is a transversal, sectional view of a first embodiment of the improved roller as shown in FIG. 8, with one shell segment removed from the mounting sleeve.

As shown in FIG. 8, a first embodiment of the improved roller 20 according to this invention comprises a roller shaft 21, a cylindrical mounting sleeve 22 tightly fit over the roller shaft 21, a roller shell 23 split into a plurality of shell segments 23A which are detachably mounted onto the peripheral surface of the mounting sleeve 22, and two flanges 24 fixedly mounted onto two opposite ends of mounting sleeve 22. Mounting sleeve 22 is provided with a plurality of longitudinal slots 22A equally spaced around the peripheral outer surface, as shown in FIG. 9. Each shell segment 23A, as shown in FIG. 10, has a cross section of generally sector shape, an outer side provided with a plurality of arcuated grooves 25 and ridges 25A, an inner side provided with a longitudinal key 23B to fit longitudinal slot 22A of mounting sleeve 22, and countersunk holes in which capscrews 26 are inserted for securing the shell segment 23A onto mounting sleeve 22 as shown in FIGS. 8 and 9. With the plurality of shell segments 23A mounted around the mounting sleeve 22, the arcuate grooves 25 are connected into annular grooves and the arcuate ridges are connected into annular ridges.

Shell segments 23A may be made of cast iron or cast steel with arcuate grooves 25 and arcuate ridges 25A readily formed therewith; however, the shell segments may be made without the arcuate grooves and ridges, which grooves and ridges may be cut and formed after the shell segments are assembled to the mounting sleeve 22.

To assure an accurate fit of longitudinal key 23B of shell segment 25A into longitudinal slot 22A of mounting sleeve 22, both the longitudinal keys 23B and longitudinal slots 22A are finished to provide a fine, smooth surface.

Flanges 24 are made of case iron or cast steel into a circular disc shape and are fixedly mounted onto the two opposite ends of the mounting sleeve with capscrews 27, as shown in FIG. 8. As it can be readily understood, the arrangement of the roller shell according to the first embodiment of this invention enables quick repair or replacement of the roller shell by replacing the individual shell segments without the need of dismounting the roller from the mill. Furthermore, with the shell segments provided as a member separate from the mounting sleeve, the shell segments assembled into a composite roller shell require less material than a conventional one piece roller shell of the same size; therefore the cost for replacing a roller shell is reduced.

Figure 11:
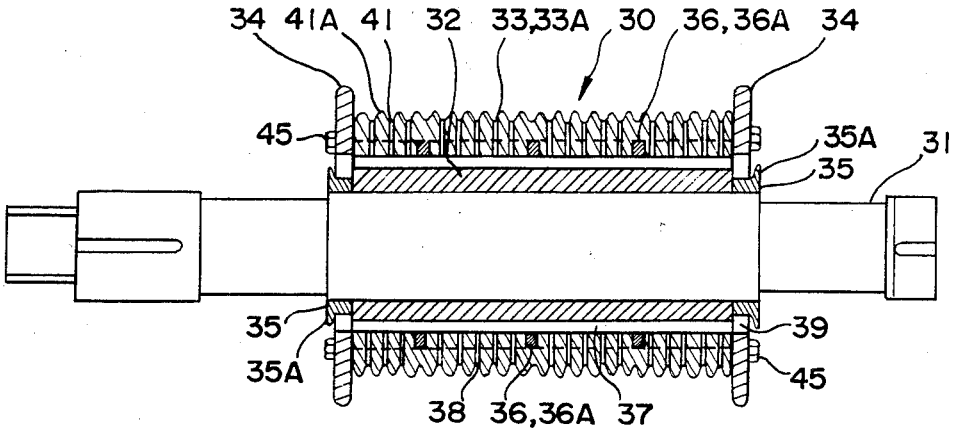
FIG. 11 is a longitudinal, sectional view of a second embodiment of the improved roller according to this invention.
Figure 13:
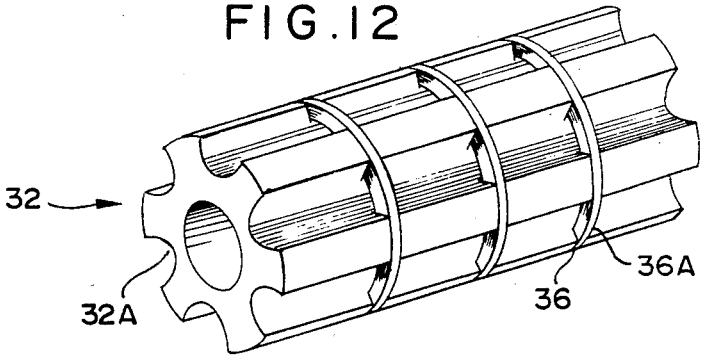
FIG. 13 is an oblique, perspective view of the mounting sleeve employed in the second embodiment of the improved roller as shown in FIG. 11.

FIG. 11 shows a second embodiment of this invention. In this embodiment, the roller 30 comprises a roller shaft 31, a cylindrical mounting sleeve 32 tightly fit over the roller shaft 31, a roller shell 33 split into a plurality of shell segments 33A which are detachably mounted onto the peripheral surface of the mounting sleeve 32, two flanges 34 fixedly mounted onto two opposite ends of mounting sleeve 32 and roller shell 33, and two end rings 35 fixedly provided at the ends of mounting sleeve 32. Mounting sleeve 32 is provided with a plurality of longitudinal slots 32A, as shown in FIGS. 13 and 14, with the bottom of slots 32A equally spaced around the peripheral outer surface thereof, as shown in FIGS. 13 and 14, with the bottom of the slots deepened and rounded in comparison with that of the first embodiment. The mounting sleeve 32 is further provided with transversal grooves 36 suitably spaced along the longitudinal axis split, annular ring 36A is inserted in each transversal groove 36 as shown in FIGS. 11 and 13. Each shell segment 33A shown in FIGS. 15, 16 and 17 has cross section of generally sector-shape, an outer side provided with a plurality of arcuated grooves 41 and arcuated ridges 41A, an inner side provided with a row of longitudinal keys 33B to fit the longitudinal slot 32A of the mounting sleeve 32, the row of longitudinal keys 33B being intermitted with transversal slots 33C as shown in FIGS. 15 and 16, to correspond with annular split rings 36A (FIG. 13), so that the annular split rings 36A fit in the transversal slots 33C to prevent shell segments 33A from moving longitudinally, as shown in FIG. 11. Each shell segment 33A is also provided with countersunk holes 42 in which capscrews 43 are inserted to fasten the shell segments 33A onto the peripheral surface of mounting sleeve 32 as shown in FIG. 14. Since the longitudinal slots 32A are deepened, a space is provided between the bottom of each longitudinal slot 32A and the row of longitudinal keys 33B fit in the longitudinal slot 32A, such space forming a longitudinal passage 37 from one end to the opposite end of the mounting sleeve 32 as shown in FIGS. 11 and 14.

Each shell segment 33A is further provided with juice collecting ports 38 in each arcuated groove 41 to pierce through the shell body and longitudinal keys 33B as shown in FIGS. 11, 15 16 and 17, so that the juice collecting ports 38 communicate with longitudinal passage 37.

Figure 5:
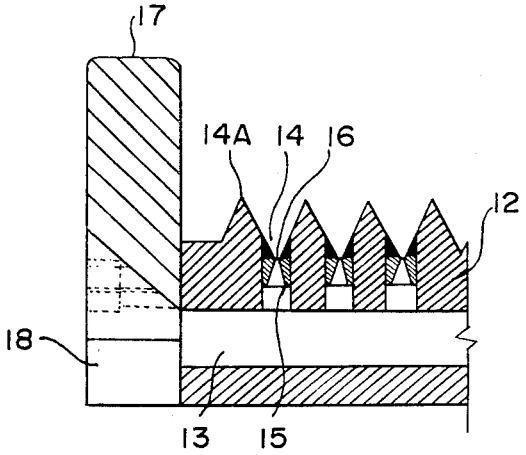
FIG. 5 PRIOR ART
FIG. 5 is an enlarged, fragmentary longitudinal sectional view of the top roller as shown in FIG. 4.
Figure 6:
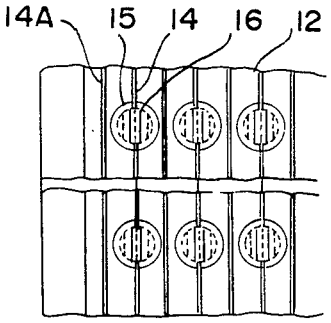
FIG. 6 PRIOR ART
FIG. 6 is an enlarged, fragmentary front view of the top roller as shown in FIG. 4, showing an arrangement of the juice collecting ports.
Figure 7:
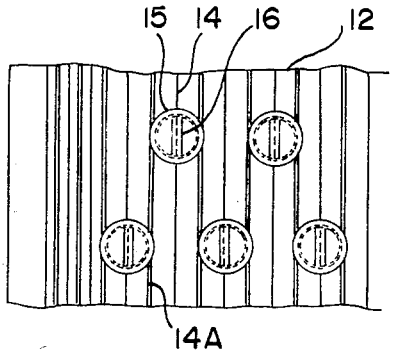
FIG. 7 PRIOR ART
FIG. 7 is an enlarged fragmentary front view of the top roller as shown in FIG. 4, showing another arrangement of the juice collecting ports.

As shown in FIGS. 14–16, because the shell segments 33A are each formed into sector-like members instead of as an integral cylindrical roller shell unit, the inner portion of each juice collecting port 38 may be enlarged as by drilling from the inner or back side of the shell segments 33A, thus eliminating the need for provision of the plug members 15 required in the conventional rollers shown in FIGS. 5–7 wherein conventionally a discharge nozzle 16 is formed by placing a plug member 15 into a relatively large hole which must necessarily be drilled from the outer side of the cylindrical roller shell 12. The elimination of the use of the plug members 15 provides more space for additional juice collecting ports 38, as shown in FIGS. 14 and 15, so as to enable the formation of two juice collecting ports 38 in tandem in each arcuated groove 41 of each shell segment 33A to communicate with a corresponding one of the longitudinal passages 37, thus providing additional capacity for collecting the cane juice.

Figure 12:
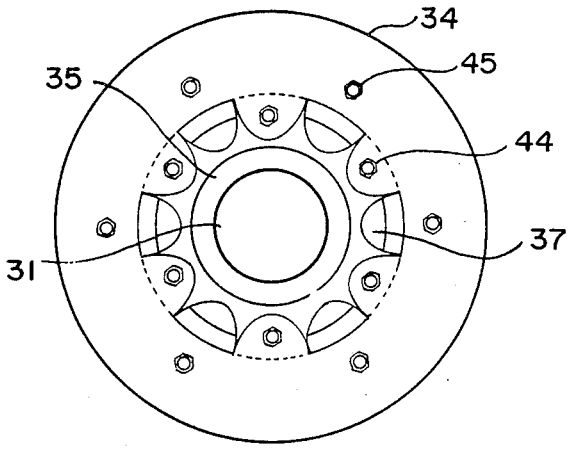
FIG. 12 is a side view of the second embodiment of the improved roller according to this invention.

As shown in FIGS. 11 and 12, each flange 34 has a openings 39 open to clear from the open end of each passage 37, and is mounted onto one end of mounting sleeve 32 and roller shell 33 with capscrews 44 and 45 respectively.

Each juice collecting ring 35 is provided with a flange 35A (FIG. 11) and is mounted on the roller shaft 31 to abut one end of mounting sleeve 32 so as to allow the cane juice collected through juice collecting ports 38, passage 37 and openings 39 to flow along the flange 35A of juice collecting ring 35 as shown in FIG. 11, and finally to drop into the receiver, not shown.

As mentioned with respect to the first embodiment, shell segments 33A may be made of cast iron or cast steel with arcuate grooves 33 and ridges 33A readily formed; however, shell segments may be made without the arcuate grooves 33 and ridges 33A, which grooves and ridges may be cut and formed after the shell segments 33A are assembled onto the roller shaft.

In order to assure an accurate fit of longitudinal keys 33B of shell segments 33A into longitudinal slots 32A of mounting sleeve 32, both the longitudinal keys 33B and longitudinal slots 32A are finished to provide a fine, smooth surface, which also facilitates a smooth flow of cane juice through the passage formed therebetween.

Figure 1:
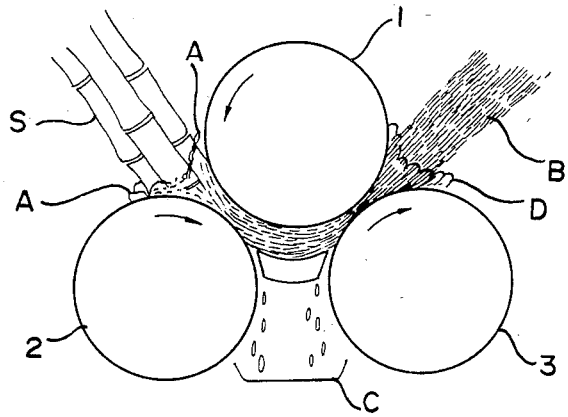
FIG. 1 PRIOR ART
FIG. 1 is a schematic side view of a conventional sugar cane squeezing mill.
Figure 2:
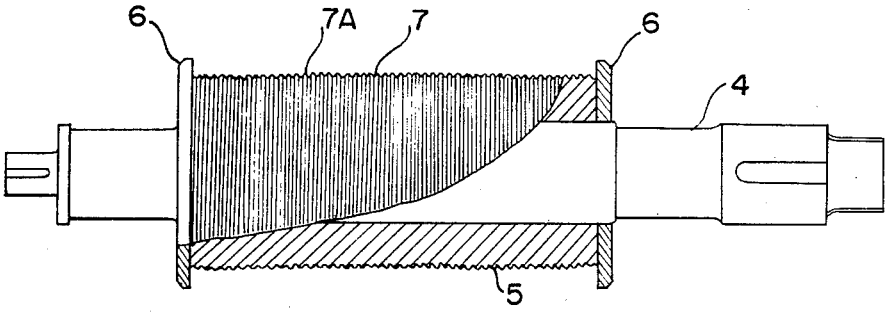
FIG. 2 PRIOR ART
FIG. 2 is a front view of a roller of a conventional sugar cane squeezing mill, partially in section.
Figure 3:
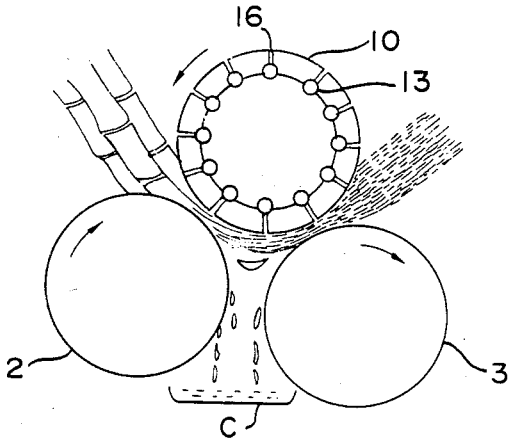
FIG. 3 PRIOR ART
FIG. 3 is a schematic side view of another conventional sugar cane squeezing mill.
Figure 4:
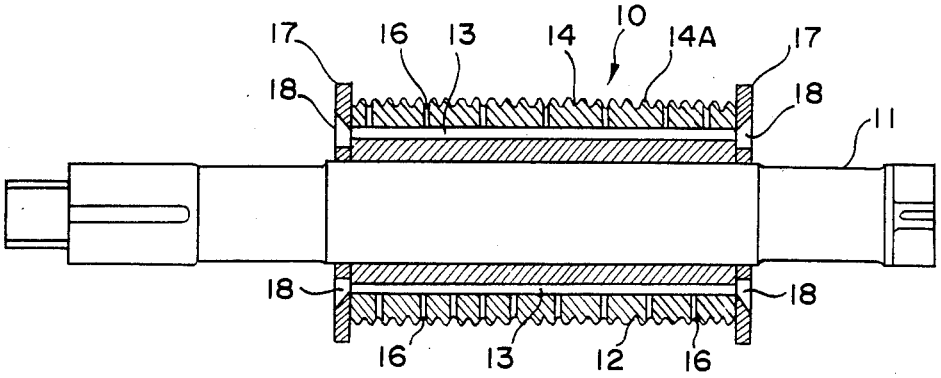
FIG. 4 PRIOR ART
FIG. 4 is a longitudinal sectional view of the top roller of the conventional sugar cane squeezing mill shown in FIG. 3.

The roller of the second embodiment when used as a top roller is capable of collecting the cane juice remaining at entry zone A of FIG. 1, and also of reducing the machine down time and the costs of repair of the roller shell.

Although the improved roller of this invention has been described with respect to two preferred embodiments, it is to be understood that the construction and arrangement of the improved roller of this invention may be modified in various ways without departing from the spirit of this invention. For example, the split ring 36A may be replaced by a dowel pin or even eliminated; and the flanges may be integrally made with the mounting sleeve, or even eliminated.

What I claim is:

1. An improved roller for a sugar cane squeezing mill, comprising:

a roller shaft;

a cylindrical mounting sleeve fixedly mounted over said roller shaft, said sleeve having a plurality of longitudinal slots equally spaced radially around a peripheral outer surface thereof; and a plurality of roller shell segments each having a cross section of generally sector shape, an outer side provided with arcuate grooves and ridges and an inner side provided with a longitudinal key to fit one of said longitudinal slots of said mounting sleeve, said roller shell segments being radially detachably mounted onto said peripheral outer surface of said mounting sleeve;

a space being provided between each said longitudinal slot of said mounting sleeve and each said longitudinal key of said mounted roller shell segments to form a passage therebetween extending along the length of said mounting sleeve, each said groove of each said roller shell segment being provided with two juice collecting ports communicating with said passage.

* * * * *